United States Patent [19]

Suzuki et al.

[11] Patent Number: 4,614,682

[45] Date of Patent: Sep. 30, 1986

[54] THERMOSENSITIVE IMAGE TRANSFER RECORDING MEDIUM

[75] Inventors: Akira Suzuki, Mishima; Hideo Watanabe, Kawasaki; Mitsuru Hashimoto, Numazu; Nobuo Mochizuki, Shizuoka; Keishi Kubo, Yokohama; Susumu Tatsumi, Hino; Toshiyuki Kawanishi, Numazu, all of Japan

[73] Assignee: Ricoh Company, Ltd., Tokyo, Japan

[21] Appl. No.: 785,715

[22] Filed: Oct. 9, 1985

[30] Foreign Application Priority Data

Oct. 11, 1984[JP] Japan ..... 59-211496
Feb. 14, 1985[JP] Japan ..... 60-025169

[51] Int. Cl.[4] ..... B41M 5/26

[52] U.S. Cl. ..... 428/213; 106/23; 106/31; 428/207; 428/323; 428/336; 428/484; 428/488.1; 428/488.4; 428/913; 428/914

[58] Field of Search ..... 106/23, 31; 428/195, 428/212, 213, 323, 336, 484–488.4, 913, 914

[56] References Cited

U.S. PATENT DOCUMENTS

| | | | |
|---|---|---|---|
| 3,931,025 | 1/1976 | Woditsch et al. | 106/288 B |
| 4,472,479 | 9/1984 | Hayes et al. | 428/488.4 |
| 4,536,434 | 8/1985 | Magnotta | 428/488.4 |

FOREIGN PATENT DOCUMENTS

| | | | |
|---|---|---|---|
| 0719896 | 3/1980 | U.S.S.R. | 428/488.4 |

*Primary Examiner*—Bruce H. Hess
*Attorney, Agent, or Firm*—Oblon, Fisher, Spivak, McClelland & Maier

[57] ABSTRACT

A thermosensitive image transfer recording medium comprising a support material and an thermofusible ink layer formed thereon, which thermofusible ink layer comprises a dye component, a binder agent and a pigment having a needle-like crystal form, which is dispersed in a network form throughout the thermofusible ink layer.

19 Claims, 3 Drawing Figures

THERMOSENSITIVE IMAGE TRANSFER RECORDING MEDIUM

BACKGROUND OF THE INVENTION

The present invention relates to a thermosensitive image transfer recording medium capable of yielding images with high and uniform image density and with excellent density modulations (image gradation) on a receiving sheet by application of heat to a thermofusible ink layer of the recording medium through a thermal head or the like so as to imagewise transfer a dye contained in the ink layer to the receiving sheet, thereby forming recorded images on the receiving sheet. More particularly, the present invention relates to a thermosensitive image transfer recording medium comprising a support material and an thermofusible ink layer formed thereon, which thermofusible ink layer comprising a dye component, a pigment having a needle-like crystal form, and a binder agent having a low melting point.

Conventionally, there is known a thermosensitive image transfer method of forming recorded images on a receiving sheet by subjecting a thermosensitive image transfer medium to thermal printing, which image transfer medium consists of a support and an image transfer layer formed thereon comprising a thermofusible material and a pigment. This method is excellent in thermal printing response and preservability. However it has the shortcoming that the available density modulations are limited and poor.

SUMMARY OF THE INVENTION

It is therefore an object of the present invention to provide a thermosensitive image transfer recording medium which is capable of yielding images with high and uniform image density and with excellent density modulations, and which is also excellent in thermal printing response and preservability.

In the present invention, the above object is achieved by a thermosensitive image transfer recording medium comprising a support material and an thermofusible ink layer formed thereon, which thermofusible ink layer comprising a dye component, a pigment having a needle-like crystal form (hereinafter referred to the needle pigment), and a binder agent having a low melting point, and which needle pigment is dispersed in a network form throughout the thermofusible ink layer.

DETAILED DESCRIPTION OF THE PREFERRED EMBODIMENTS

By referring to FIG. 1, thermal image transfer by use of a thermosensitive image transfer recording medium according to the present invention will now be explained.

Figure 1:
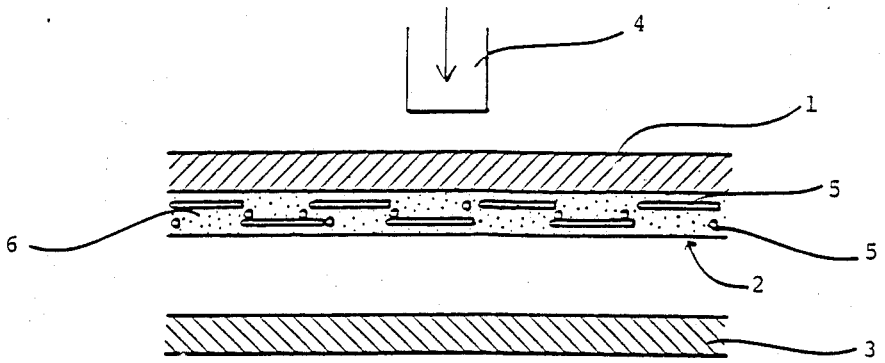
FIG. 1 is a schematic illustration of a cross-sectional view of a thermosensitive image transfer recording medium according to the present invention and a cross-sectional view of a counterpart receiving sheet in explanation of the arrangement thereof for thermal image transfer.

As shown in FIG. 1, a thermosensitive image transfer recording medium consists of a support material 1 and a thermofusible ink layer 2 containing a dye component 6. When recording is carried out, the recording medium is superimposed on a receiving sheet 3 in such a manner that the thermofusible ink layer 2 comes into close contact with the receiving sheet 3. A thermal head 4 is then brought into contact with the support material 1 and imagewise energized. Accordingly the thermofusible ink layer 2 is imagewise melted and the dye component 6 is transferred to the receiving sheet 3.

Figure 2:
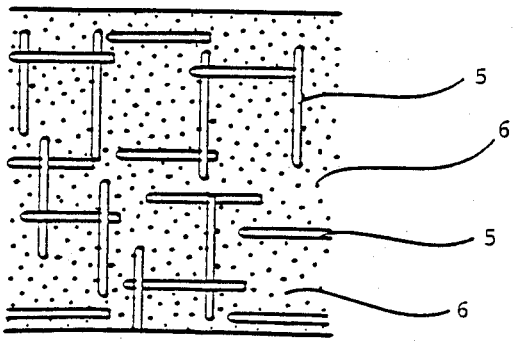
FIG. 2 is a schematic illustration of a horizontal sectional view of a thermosensitive image transfer layer in explanation of a needle pigment network in the image transfer layer.
Figure 3:
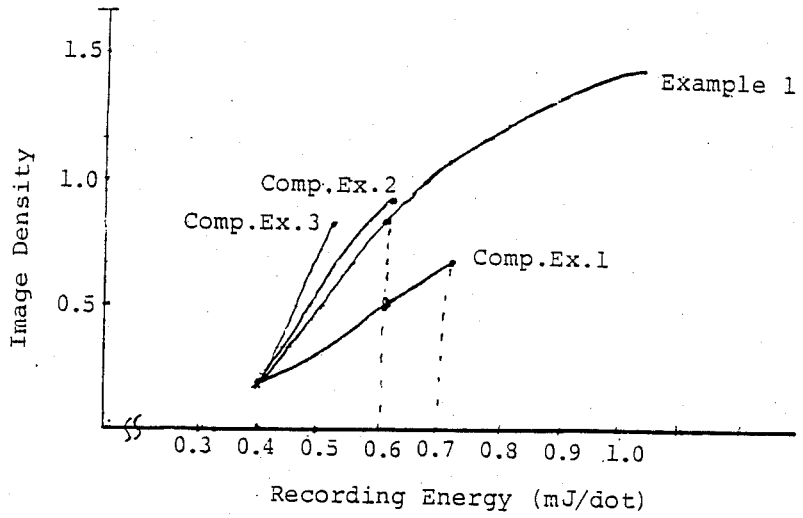
FIG. 3 is a graph showing the relationship between the applied thermal energies per dot and the recorded image densities obtained by a thermosensitive image transfer recording medium according to the present invention and by comparative thermosensitive image transfer recording mediums.

In the present invention, a needle pigment 5 is contained in the thermofusible ink layer 2 and it is considered that the needle pigment 5 constitutes a network as illustrated in FIG. 2, so that the dye component 6, a thermofusible binder agent and other components are held by the pigment network. Further, it is considered that when heat is applied to the image transfer recording medium by a thermal head, the dye component 6 oozes out of the thermofusible ink layer 2 through the pigment network and is then transferred to the receiving sheet 3. The amount of the dye component 6 that oozes out of the thermofusible ink layer 2 is proportional to the amount energy applied to the thermofusible ink layer 2 by the thermal head which is in contact with the image transfer recording medium. In other words, by controlling the amount applied to the thermofusible ink layer 2, the density modulations of the images transferred to the image transfer sheet 3 can be controlled.

The needle pigment 5 for use in the present invention will now be explained in more detail. It is preferable that the length of each needle pigment 5 be in the range of about 0.3 to 3 μm, the width and the thickness be 0.3 μm or less. In the present invention, when heat is applied to the thermosensitive image transfer recording medium, the dye component 6 oozes out of the above-mentioned network of the pigment 5, but the pigment 5 itself is hindered to transfer to the receiving sheet 3 because of the above-mentioned network fabricated throughout the thermofusible ink layer 2. However, in order to avoid mixing of the needle pigment 5 with the dye component 6 at the application of heat, it will be safer to select a pigment having a similar or other suitable color for the dye component 6.

It is preferable that the thickness of the thermofusible ink layer 2 be in the range of 1 to 10 μm, more preferably in the range of 1 to 5 μm, from the view point of the thermal printing sensitivity.

It is preferable that the amount of the needle pigment 5 added to the thermofusible ink layer 2 be in the range of 0.5 to 10 parts by weight, more preferably 1 to 5 parts by weight, to one part by weight of the dye component.

As such needle pigments for use in the present invention, not only inorganic pigments, but also organic pigments can be employed as long as they are in the form of needles and can constitute a network in the thermofusible ink layer 2.

Specific examples of such needle pigments are ochre, Chrome Yellow G, Phthalocyanine pigments such as Phthalocyanine Blue, Lithol Red, BON Maroon Light, terra abla, needle zinc oxide, 2,7-bis[2-hydroxy-3-(2-chlorophenylcarbamoyl)naphthalene-1-ylazo]-9-fluorenone, 4',4''-bis [2-hydroxy-3-(2,4-dimethylphenyl)carbamoylnaphthalene-1-ylazo]-1,4-distyrylbenezene.

It is considered that the above needle pigments each constitute a network when they are sufficiently dispersed, preferably by subjecting them to an additional milling process, together with a dye, a binder agent and an appropriate organic solvent to prepare a thermofusible ink layer formation liquid as will be explained later and the liquid is coated on the support material. For coating the liquid, no special coating means is necessary, but a conventional coating means can be employed in a conventional manner.

As dye components for use in the present invention, the dyes mentioned below are suitable. Generally, it is preferable that the eutectic temperatures of the dyes to be used with a binder agent be in the range of 50° C. to 140° C., although the eutectic temperatures vary depending upon the binder agent to be used in combination.

Examples of such dyes are direct dyes, acid dyes, basic dyes, mordant dyes, sulfur dyes, building dyes, azoic dyes, oil dyes and thermosublimable disperse dyes.

Specific examples of the above dyes are as follows:

(1) Direct Dyes: Direct Sky Blue and Direct Black W
(2) Acid Dyes: Tartrazine, Acid Violet 6B and Acid Fast Red 3G
(3) Basic Dyes: Safranine, Auramine, Crystal Violet, Methylene Blue, Rhodamine B and Victoria Blue B.
(4) Mordand Dyes: Sunchromine Fast Blue MB, Eriochrome Azurol B and Alizarin Yellow
(5) Sulfur Dyes: Sulphur Brilliant Green 4G
(6) Building Dyes: Indanthrene Blue
(7) Azoic Dyes: Napthol AS
(8) Oil Dyes: Nigrosine, Spirit Black EB, Varifast Orange 3206, Oil Black 215, Butter Yellow, Sudan Blue II, Oil Red B and Rhodamine B
(9) Thermosublimable Disperse Dyes:
  (9-1) Monoazo Disperse Dyes: Disperse Fast Yellow G, Disperse Fast Yellow 5G, Disperpse Fast Yellow 5R and Disperse Fast Red R;
  (9-2) Anthraquinone Disperse Dyes: Disperse Fast Violet OR, Disperse Fast Violet B, Disperse Blue Extra and Disperse Fast Brilliant Blue B; and
  (9-3) Nitrodiphenylamine Disperse Dyes: Disperse Fast Yellow RR and Disperse Fast Yellow GL It is preferable that the particle sizes of these dyes be smaller than those of the needle pigments. It is preferable that the above dyes be in a dissolved state.

In the thermosensitive image transfer recording medium according to the present invention, conventional binder agents are employed for firmly binding the thermofusible ink layer 2 to the support material 1. It is preferable that the binder agents for use in the present invention have melting points or softening points in the range of 50° C. to 130° C.

Specific examples of such binder agents are polyethylene, polyproylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, rubber chloride, butadiene rubber, olefin rubber, phenolic resin, urea resin, melamine resin, polyimide and waxes such carnauba wax, montan wax, paraffin wax and microcrystalline wax.

When a thermofusible ink layer 2 containing at least one of the above binder agents is formed on the support material 1, a conventional coating method, for example, the solvent-coating method, the hot-melt coating method and the aqueous-emulsion coating method, can be employed.

In order to firmly fix the thermofusible ink layer 2 to the support material 1, an intermediate adhesive layer comprising a resin can be interposed between the support material 1 and the thermofusible ink layer 2. As resins for the intermediate adhesive layer, polyethylene, polyproylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, rubber chloride, butadiene rubber, olefin rubber, phenolic resin, urea resin, melamine resin and polyimide can be employed. The above-mentioned binder agents can be directly coated on the support material 1 so as to support thereon the thermofusible ink layer 2. It is preferable that the thickness of the intermediate adhesive layer be in the range of about 1 to about 2 μm.

As the support material 1, for example, polyester film, polypropylene film, polycarbonate film, cellulose triacetate film, polyimide film, glassine paper and condenser paper, having a thickness ranging from 3 μm to 20 μm can employed.

As the receiving sheet 3, plain paper can be employed. If necessary, a layer containing one of the above-mentioned resins and titanium oxide ($TiO_2$), silica or zinc oxide ($ZnO_2$) can be formed on the plain paper for facilitating the transfer of a dye component from the thermofusible ink layer 2 to the transfer sheet 3.

By referring to the following examples, the present invention will now be explained more specifically:

EXAMPLE 1

(1) Preparation of Thermosensitive Image Transfer Recording Medium No. 1

A mixture of the following components was dispersed in a ball mill, so that a thermofusible ink layer formation liquid was prepared:

| | Part by Weight |
|---|---|
| Sudan Blue II | 10 |
| 2,7-bis[2-hydroxy-3-(2-chlorophenylcarbamoyl)naphthalene-1-ylazo]-9-fluorenone (needle pigment) | 20 |
| Polyester resin (m.p. about 60° C.) | 3 |
| Dichloroethane | 100 |

The thus prepared thermofusible ink layer formation liquid was coated on a polyester film having a thickness of 6 μm by a wire bar, so that a thermofusible ink layer with a deposition of 3 g/m$^2$ when dried (having a thickness of about 3 μm) was formed on the polyester film, whereby a thermosensitive image transfer recording medium No. 1 according to the present invention was prepared.

Microscopic observation of the thermofusible ink layer indicated that the needle pigment formed a network.

(2) Image Transfer Test by Use of Thermosensitive Image Transfer Recording Medium No. 1

Image Transfer Recording Medium No. 1 was superimposed on a sheet of plain paper in such a manner that the thermofusible ink layer came into close contact with the plain paper. A thermal head was then applied to the back side of the image transfer recording medium, with the applied thermal energy per dot varied as shown below, so that cyan-colored images were obtained. The relationship between the applied thermal energies and the obtained image densities was as follows:

TABLE 1

| Thermal Energy (mJ/dot) | 0.3 | 0.4 | 0.5 | 0.6 | 0.7 | 0.8 | 1.0 |
|---|---|---|---|---|---|---|---|
| Image Density | 0.06 | 0.15 | 0.50 | 0.80 | 1.09 | 1.17 | 1.30 |

As shown in Table 1, the image density varied in accordance with the variation of the amount of the applied thermal energy, indicating the availability of image density modulations suitable for practical use.

The transferred-image-bearing recording sheet was placed in a constant-temperature chamber at 60° C. for 50 hours. The image density scarcely changed.

EXAMPLE 2

(1) Preparation of Thermosensitive Image Transfer Recording Medium No. 2

A mixture of the following components was dispersed in a ball mill, so that a thermofusible ink layer formation liquid was prepared:

| | Part by Weight |
|---|---|
| Rhodamine B | 10 |
| 4',4''-bis[2-hydroxy-3-(2,4-dimethylphenylcarbamoylnaphthalene-1-ylazo]-1,4-distyrylbenzene (needle pigment) | 20 |
| Polystyrene (m.p. about 80° C.) | 3 |
| Dichloroethane | 100 |

The thus prepared thermofusible ink layer formation liquid was coated on a polyester film having a thickness of 6 μm by a wire bar, so that a thermofusible ink layer with a deposition of 4.5 g/m$^2$ when dried (having a thickness of about 4 μm) was formed on the polyester film, whereby a thermosensitive image transfer recording medium No. 2 according to the present invention was prepared.

Microscopic observation of the thermofusible ink layer indicated that the needle pigment formed a network.

(2) Image Transfer Test by Use of Thermosensitive Image Transfer Recording Medium No. 2

The above prepared Image Transfer Recording Medium No. 2 was superimposed on a sheet of plain paper in such a manner that the thermofusible ink layer came into close contact with the plain paper. A thermal head was then applied to the back side of the image transfer recording medium, with the applied thermal energy per dot varied as shown below, so that magenta-colored images were obtained. The relationship between the applied thermal energies and the obtained image densities was as follows:

TABLE 2

| Thermal Energy (mJ/dot) | 0.4 | 0.5 | 0.6 | 0.7 | 0.8 |
|---|---|---|---|---|---|
| Image Density | 0.09 | 0.38 | 0.75 | 0.98 | 1.09 |

As shown in Table 2, the image density varied in accordance with the variation of the amount of the applied thermal energy to such an extent that the image density modulations are suitable for practical use.

EXAMPLE 3

(1) Preparation of Thermosensitive Image Transfer Recording Medium No. 3

A mixture of the following components was dispersed in a ball mill, so that a thermofusible ink layer formation liquid was prepared:

| | Part by Weight |
|---|---|
| Butter Yellow | 10 |
| Ochre (needle pigment) | 20 |
| Polyester resin (m.p. about 60° C.) | 3 |
| Dichloroethane | 100 |

The thus prepared thermofusible ink layer formation liquid was coated on a polyester film having a thickness of 6 μm by a wire bar, so that a thermofusible ink layer with a deposition of 2.0 g/m$^2$ when dried (having a thickness of about 2 μm) was formed on the polyester film, whereby a thermosensitive image transfer recording medium No. 3 according to the present invention was prepared.

Microscopic observation of the thermofusible ink layer indicated that the needle pigment formed a network.

(2) Image Transfer Test by Use of Thermosensitive Image Transfer Recording Medium No. 3

Image Transfer Recording Medium No. 3 was superimposed on a sheet of plain paper in such a manner that the thermofusible ink layer came into close contact with the plain paper. A thermal head was then applied to the back side of the image transfer recording medium, with the applied thermal energy per dot varied as shown below, so that magenta-colored images were obtained. The relationship between the applied thermal energies and the obtained image densities was as follows:

TABLE 3

| Thermal Energy (mJ/dot) | 0.4 | 0.5 | 0.6 | 0.7 | 0.8 |
|---|---|---|---|---|---|
| Image Density | 0.09 | 0.34 | 0.72 | 1.01 | 1.14 |

As shown in Table 3, the image density varied in accordance with the variation of the amount of the applied thermal energy to such an extent that the image density modulations are suitable for practical use.

COMPARATIVE EXAMPLE 1

(1) Preparation of Comparative Thermosensitive Image Transfer Recording Medium No. 1

Example 1 was repeated except the needle pigment employed in Example 1 was replaced by carbon black in substantially spherical particles, so that a comparative thermosensitive image transfer recording medium No. 1 was prepared.

More specifically, a mixture of the following components was dispersed in a ball mill, so that a comparative thermofusible ink layer formation liquid was prepared:

| | Part by Weight |
|---|---|
| Sudan Blue II | 10 |
| Carbon black (substantially spherical pigment particles having an average particle size of 0.025 μm - Trade Mark "Printex 90") | 20 |
| Polyester resin (m.p. about 60° C.) | 3 |
| Dichloroethane | 100 |

The thus prepared thermofusible ink layer formation liquid was coated on a polyester film having a thickness of 6 μm by a wire bar, so that a thermofusible ink layer with a deposition of 3 g/m$^2$ when dried (having a thickness of about 3 μm) was formed on the polyester film, whereby a comparative thermosensitive image transfer recording medium No. 1 was prepared.

Microscopic observation of the thermofusible ink layer indicated that the carbon black particles did not form a network, but were merely dispersed at random in the thermofusible ink layer 2.

(2) Image Transfer Test by Use of Comparative Thermosensitive Image Transfer Recording Medium No. 1

Comparative image transfer recording medium No. 1 was superimposed on a sheet of plain paper in such a manner that the thermofusible ink layer came into close contact with the plain paper. A thermal head was then applied to the back side of the image transfer recording medium, with the applied thermal energy per dot varied as shown below, so that cyan-colored images were obtained. The relationship between the applied thermal energies and the obtained image densities was as follows:

TABLE 4

| Thermal Energy (mJ/dot) | 0.4 | 0.5 | 0.6 | 0.7 |
|---|---|---|---|---|
| Image Density | 0.1 | 0.25 | 0.50 | 0.65 |

As shown in Table 4, the image density varied in accordance with the variation of the amount of the applied thermal energy. However, the image density modulations suitable for practical use were not available.

When 0.7 mJ/dot or more thermal energy was applied, not only the dye (Sudan Blue II), but also the pigment (Carbon Black) was transferred to the receiving sheet, so that no clear images were obtained.

COMPARATIVE EXAMPLE 2

Example 1 was repeated except the needle pigment employed in Example 1 was replaced by carbon black in the form of spherical particles having an average particle size of 0.07 m (Trade Mark "Raven 410"), whereby a comparative thermosensitive image transfer recording medium No. 2 was prepared.

Comparative thermosensitive image transfer recording medium No. 2 was subjected to the same image transfer test as in Example 1. The results were as shown below:

TABLE 5

| Thermal Energy (mJ/dot) | 0.4 | 0.5 | 0.6 |
|---|---|---|---|
| Image Density | 0.15 | 0.5 | 0.92 |

As shown in Table 5, the image density varied in accordance with the variation of the amount of the applied thermal energy. However, the image density modulations suitable for practical use were not available.

When 0.6 mJ/dot or more thermal energy was applied, not only the dye (Sudan Blue II), but also the pigment (Carbon Black) was transferred to the receiving sheet, so that no clear images were obtained. Therefore, the image density modulations suitable for practical use were not available.

COMPARATIVE EXAMPLE 3

Example 1 was repeated except the needle pigment employed in Example 1 was replaced by a commercially available graphite in the form of spherical particles having an average particle size of 1.0 μm (Trade Mark "UFG-5"), whereby a comparative thermosensitive image transfer recording medium No. 3 was prepared.

Comparative thermosensitive image transfer recording medium No. 3 was subjected to the same image transfer test as in Example 1. The results were as shown below:

TABLE 6

| Thermal Energy (mJ/dot) | 0.4 | 0.5 |
|---|---|---|
| Image Density | 0.15 | 0.85 |

As shown in Table 6, the image density varied in accordance with the variation of the amount of the applied thermal energy. However, the image density modulations suitable for practical use were not available. More specifically, when 0.5 mJ/dot or more thermal energy was applied, not only the dye (Sudan Blue II), but also the pigment (graphite) was transferred to the receiving sheet, so that no clear images were obtained.

COMPARATIVE EXAMPLE 4

Example 1 was repeated except the needle pigment employed in Example 1 was replaced by a commercially available zinc oxide in the form of spherical particles having an average particle size of 0.5 μm (Trade Mark "Sazex 400"), whereby a comparative thermosensitive image transfer recording medium No. 4 was prepared.

Comparative thermosensitive image transfer recording medium No. 4 was subjected to the same image transfer test as in Example 1. The result was that almost from the beginning of the application of thermal energy, that is, at application of about 0.4 mJ/dot of thermal energy, not only the dye (Sudan Blue II), but also the pigment (ZnO) was transferred to the receiving sheet, so that no clear images were obtained at all. This comparative thermosensitive image transfer recording medium was totally unsuitable for use in practice.

COMPARATIVE EXAMPLE 5

Example 1 was repeated except the needle pigment employed in Example 1 was replaced by a commercially available organic pigment in the form of spherical particles having an average particle size of 0.05 μm (Trade Mark "Reflex Blue R50"), whereby a comparative thermosensitive image transfer recording medium No. 5 was prepared.

Comparative thermosensitive image transfer recording medium No. 5 was subjected to the same image transfer test as in Example 1. The result was that almost from the beginning of the application of thermal energy, that is, at application of about 0.4 mJ/dot of thermal energy, not only the dye (Sudan Blue II), but also the pigment was transferred to the receiving sheet, so that no clear images were obtained at all. This comparative thermosensitive image transfer recording medium was also totally unsuitable for use in practice.

COMPARATIVE EXAMPLE 6

Example 1 was repeated except the needle pigment employed in Example 1 was replaced by a commercially available organic pigment in the form of spherical particles having an average particle size of not more than 0.1 μm (Trade Mark "Hostaperm Pink K Transparent"), whereby a comparative thermosensitive image transfer recording medium No. 6 was prepared.

Comparative thermosensitive image transfer recording medium No. 6 was subjected to the same image transfer test as in Example 1. The result was that almost from the beginning of the application of thermal energy, that is, at application of about 0.4 mJ/dot of thermal energy, not only the dye (Sudan Blue II), but also the pigment was transferred to the receiving sheet, so that no clear images were obtained at all. This comparative thermosensitive image transfer recording medium was also totally unsuitable for use in practice.

As described previously, in the present invention, binder agents having low melting points are employed for the thermofusible ink layer 2.

As such binder agents, in addition to the previously mentioned binder agents, a thermoplastic polycaprolactone having a number average molecular weight ranging from 1,000 to 100,000, with a repeated unit of $-(CH_2CH_2CH_2CH_2CH_2COO)-_n$, can be employed. The advantages of the polycaprolactone over other binder agents are that it has an excellent film-formation property, has a melting point ranging from 40° C. to 70° C., depending the number of the repeated units, and exhibits excellent thermal image transfer properties when used in the present invention.

Polycaprolactone is a polyester resin, which is prepared by ring-opening polymerization of ε-caprolactone. Since the repeated unit of polycaprolactone consists of a methylene group and an ester group, polycaprolactone has a relatively low melting point, with the maximum melting point ranging from 60° C. to 70° C., in spite of high polymerization degree.

The following Table 7 shows the relationship between the number average molecular weight and the melting point of polycaprolactone:

TABLE 7

| Average M.W. | Melting Point (°C.) |
|---|---|
| 1,250 | 40-50 |
| 2,000 | 45-55 |
| 3,000 | 48-58 |
| 4,000 | 48-58 |
| 8,000 | 50-58 |
| 10,000 | 60-63.5 |
| 40,000-60,000 | 61-64 |
| 70,000-100,000 | 63-71 |

By repeating the purification of polycaprolactone by use of an appropriate organic solvent, the melting point range of polycarbonate can be made narrow and sharp. For example, when polycaprolactone having an average molecular weight of 10,000 is purified by dissolving it in ethanol and then subjected to re-precipitation, the melting point range can be made narrow to a range of 59.5° C. to 61° C.

It is preferable that the average molecular weight of polycaprolactone be in the range of 8,000 to 60,000, more preferably about 10,000 (about 90 repeated units), for obtaining clear transferred images.

When a heat resisting support material is employed in the present invention, it is preferable that polycaprolactone having an average molecular weight ranging from 70,000 to 100,00 be mixed in an amount of 5 to 30 parts by weight to 100 parts by weight of polycaprolactone having an average molecular weight of 10,000 in order to increase the adhesiveness of the polycaprolactone to the heat resisting support material.

Instead of the polycaprolactone having an an average molecular weight ranging from 70,000 to 100,000, styrenebutadiene rubber, ethylene—vinylacetate copolymer, vinyl chloride—vinyl acetate copolymer, ethylcellulose, polyvinyl butyral, and other polyester derivatives, having softening points ranging from about 80° C. to about 110° C., can be employed.

When the above described polycaprolactone is employed in the thermofusible ink layer 2, it is preferable that the total amount of the polycaprolactone be in the range of 99 wt. % to 60 wt. % and the dye be in the range of 1 wt. % to 40 wt. % in order to firmly fix the thermofusible ink layer 2 to the support material, thereby preventing the thermofusible ink layer 2 from peeling off the support material 1, and to attain perfect image transfer.

The thermofusible ink layer 2 comprising a polycaprolactone is formed by dissolving uniformly a dye and a polycaprolactone in a solvent, such as benzene, toluene, xylene, methyl ethyl ketone, carbon tetrachloride, tetrahydrofuran, dioxane, dimethylformamide and pyridine, to prepare a thermofusible ink layer formation liquid, coating the liquid to a support material and drying the same.

In the present invention, plasticizers and waxes can be added to the thermofusible ink layer in order to improve the thermosensitivity of the recording medium.

As such waxes, carauba wax, montan wax, paraffin wax and microcrystalline wax are suitable for use in the present invention. Further, as such plasticizers, dioctylphthalate, tricresyl phosphate and dibutylphthalate are preferable. It is preferable that such waxes and plasticizers be contained in an amount of 10 wt. % or less with respect to the total amount of the thermofusible ink layer 2.

Furthermore, extender pigments (bodies) can be added to the thermofusible ink layer 2 in order to improve image transfer by fusing and to obtain clear images. As such extender pigments, silicic acid powder, calcium carbonate, magnesium carbonate, silica, kaolin and white carbon are suitable for use in the thermofusible ink layer 2. It is preferable that such extender pigment be contained in an amount of 30 wt. % or less in the thermofusible ink layer 2.

EXAMPLE 4

(1) Preparation of Thermosensitive Image Transfer Recording Medium No. 4

A mixture of the following components was dispersed in a ball mill, so that a thermofusible ink layer formation liquid was prepared:

| | Part by Weight |
|---|---|
| Sudan Blue II | 10 |
| 2,7-bis[2-hydroxy-3-(2-chlorophenylcarbamoyl)naphthalene-1-ylazo]-9-fluorenone (needle pigment) | 10 |
| Polycaprolactane (Average M.W. 2,000) | 20 |
| Dichloroethane | 200 |

The thus prepared thermofusible ink layer formation liquid was coated on a polyester film having a thickness of 6 μm by a wire bar, so that a thermofusible ink layer having a thickness of about 3.5 μm was formed on the polyester film, whereby a thermosensitive image transfer recording medium No. 4 according to the present invention was prepared.

Microscopic observation of the thermofusible ink layer indicated that the needle pigment formed a network.

(2) Image Transfer Test by Use of Thermosensitive Image Transfer Recording Medium No. 4

Image Transfer Recording Medium No. 4 was superimposed on a sheet of plain paper in such a manner that the thermofusible ink layer came into close contact with the plain paper. A thermal head was then applied to the back side of the image transfer recording medium, with the applied thermal energy per dot varied as shown below, so that cyan-colored images were obtained. The relationship between the applied thermal energies and the obtained image densities was as follows:

TABLE 8

| Thermal Energy (mJ/dot) | 0.4 | 0.5 | 0.6 | 0.7 | 0.8 |
|---|---|---|---|---|---|
| Image Density | 0.15 | 0.50 | 0.80 | 1.09 | 1.17 |

As shown in Table 8, the image density varied in accordance with the variation of the amount of the applied thermal energy, indicating the availability of image density modulations suitable for practical use.

The transferred-image-bearing recording sheet was placed in a constant-temperature chamber at 60° C. for 50 hours. The image density scarcely changed.

EXAMPLE 5

(1) Preparation of Thermosensitive Image Transfer Recording Medium No. 5

A mixture of the following components was dispersed in a ball mill, so that a thermofusible ink layer formation liquid was prepared:

| | Part by Weight |
|---|---|
| Rhodamine B | 10 |
| 4',4''-bis[2-hydroxy-3-(2,4-dimethylphenylcarbamoylnapthalene-1-ylazo]-1,4-distyrylbenzene (needle pigment) | 10 |
| Polycaprolactone (Average M.W. 6,000) | 10 |
| Dichloroethane | 200 |

The thus prepared thermofusible ink layer formation liquid was coated on a polyester film having a thickness of 6 μm by a wire bar, so that a thermofusible ink layer with a deposition of 4.5 g/m$^2$ when dried (having a thickness of about 4 μm) was formed on the polyester film, whereby a thermosensitive image transfer recording medium No. 5 according to the present invention was prepared.

Microscopic observation of the thermofusible ink layer indicated that the needle pigment formed a network.

(2) Image Transfer Test by Use of Thermosensitive Image Transfer Recording Medium No. 5

Image Transfer Recording Medium No. 5 was superimposed on a sheet of plain paper in such a manner that the thermofusible ink layer came into close contact with the plain paper. A thermal head was then applied to the back side of the image transfer recording medium, with the applied thermal energy per dot varied as shown below, so that magenta-colored images were obtained. The relationship between the applied thermal energies and the obtained image densities was as follows:

TABLE 9

| Thermal Energy (mJ/dot) | 0.4 | 0.6 | 0.8 | 1.0 | 1.20 |
|---|---|---|---|---|---|
| Image Density | 0.09 | 0.38 | 0.75 | 0.98 | 1.09 |

As shown in Table 9, the image density varied in accordance with the variation of the amount of the applied thermal energy to such an extent that the image density modulations are suitable for practical use.

EXAMPLE 6

(1) Preparation of Thermosensitive Image Transfer Recording Medium No. 6

A mixture of the following components was dispersed in a ball mill, so that a thermofusible ink layer formation liquid was prepared:

| | Part by Weight |
|---|---|
| Butter Yellow | 10 |
| Ochre (needle pigment) | 10 |
| Polycaprolactone (Average M.W. 10,000) | 20 |
| Dichloroethane | 200 |

The thus prepared thermofusible ink layer formation liquid was coated on a polyester film having a thickness of 6 μm by a wire bar, so that a thermofusible ink layer having a thickness of about 4 μm was formed on the polyester film, whereby a thermosensitive image transfer recording medium No. 6 according to the present invention was prepared.

Microscopic observation of the thermofusible ink layer indicated that the needle pigment formed a network.

(2) Image Transfer Test by Use of Thermosensitive Image Transfer Recording Medium No. 6

Image Transfer Recording Medium No. 6 was superimposed on a sheet of plain paper in such a manner that the thermofusible ink layer came into close contact with the plain paper. A thermal head was then applied to the back side of the image transfer recording medium, with the applied thermal energy per dot varied as shown below, so that magenta-colored images were obtained.

The relationship between the applied thermal energies and the obtained image densities was as follows:

TABLE 10

| Thermal Energy (mJ/dot) | 0.4 | 0.8 | 1.2 | 1.6 | 2.0 |
|---|---|---|---|---|---|
| Image Density | 0.09 | 0.34 | 0.72 | 0.90 | 1.00 |

As shown in Table 10, the image density varied in accordance with the variation of the amount of the applied thermal energy to such an extent that the image density modulations are suitable for practical use.

What is claimed is:

1. A thermosensitive image transfer recording medium comprising a support material and an thermofusible ink layer formed thereon, said thermofusible ink layer comprising a dye component, a pigment having a needle-like crystal form and a binder agent, said pigment being dispersed in a network form throughout said thermofusible ink layer.

2. A thermosensitive image transfer recording medium as claimed in claim 1, wherein the length of said pigment is in the range of about 0.3 to 3 μm, the width and the thickness of said pigment is 0.3 μm or less.

3. A thermosensitive image transfer recording medium as claimed in claim 1, wherein said pigment is selected from the group consisting of ochre, Chrome Yellow G, Phthalocyanine pigments, Lithol Red, BON Maroon Light, terra abla, needle zinc oxide, 2,7-bis[2-hydroxy-3-(2-chloro-phenylcarbamoyl)naphthalene-1-ylazo]-9-fluorenone and 4',4''-bis[2-hydroxy-3-(2,4-dimethylphenyl)-carbamoylnaphthalene-1-ylazo]-1,4-distyrylbenezene.

4. A thermosensitive image transfer recording medium as claimed in claim 1, wherein the thickness of said thermofusible ink layer is in the range of 1 to 10 μm.

5. A thermosensitive image transfer recording medium as claimed in claim 1, wherein said pigment is contained in an amount of 0.5 to 10 parts by weight to 1 part by weight of said dye component.

6. A thermosensitive image transfer recording medium as claimed in claim 1, wherein said dye component is selected from the group consisting of direct dyes, acid dyes, basic dyes, mordant dyes, sulfur dyes, building dyes, azoic dyes, oil dyes and thermosublimable disperse dyes.

7. A thermosensitive image transfer recording medium as claimed in claim 1, wherein the eutectic temperature of said dye component in combination of said binder agent is in the range of 50° C. to 140° C.

8. A thermosensitive image transfer recording medium as claimed in claim 1, wherein the particle size of said dye is smaller than the particle size of said pigment.

9. A thermosensitive image transfer recording medium as claimed in claim 1, wherein said binder agent is selected from the group consisting of polyethylene, polyproylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, rubber chloride, butadiene rubber, olefin rubber, phenolic resin, urea resin, melamine resin, polyimide and carnauba wax, montan wax, paraffin wax and microcrystalline wax.

10. A thermosensitive image transfer recording medium as claimed in claim 1, wherein said support material is selected from the group consisting of polyester film, polypropylene film, polycarbonate film, cellulose triacetate film, polyimide film, glassine paper and condenser paper.

11. A thermosensitive image transfer recording medium as claimed in claim 1, wherein said binder agent is a thermoplastic polycaprolactone having a number average molecular weight ranging from 1,000 to 100,000, having a repeated unit of $\text{-}(CH_2CH_2CH_2CH_2CH_2COO)\text{-}_n$.

12. A thermosensitive image transfer recording medium as claimed in claim 11, wherein said thermofusible ink layer comprises 99 wt. % to 60 wt. % of said thermoplastic polycaprolactone and 1 wt. % to 40 wt. % of said dye.

13. A thermosensitive image transfer recording medium as claimed in claim 1, wherein said binder agent is a combination of 5 to 30 parts by weight of a polycaprolactone having an average molecular weight ranging from 70,000 to 100,000 and 100 parts by weight of a polycaprolactone having an average molecular weight of 10,000.

14. A thermosensitive image transfer recording medium as claimed in claim 1, wherein said thermofusible ink layer further comprising a plasticizer in an amount of 10 wt. % or less with respect to the total amount of said thermofusible ink layer.

15. A thermosensitive image transfer recording medium as claimed in claim 14, wherein said plasticizer is selected from the group consisting of dioctylphthalate, tricresyl phosphate and dibutylphthalate.

16. A thermosensitive image transfer recording medium as claimed in claim 1, wherein said thermofusible ink layer further comprising an extender pigment in an amount of 30 wt. % or less with respect to the total amount of said thermofusible ink layer.

17. A thermosensitive image transfer recording medium as claimed in claim 16, wherein said extender pigment is selected from the group consisting of silicic acid powder, calcium carbonate, magnesium carbonate, silica, kaolin and white carbon.

18. A thermosensitive image transfer recording medium as claimed in claim 1, further comprising an intermediate adhesive layer comprising a resin interposed between said support material and said thermofusible ink layer.

19. A thermosensitive image transfer recording medium as claimed in claim 18, wherein said resin of said intermediate adhesive layer is selected from the group consisting of polyethylene, polyproylene, polystyrene, petroleum resin, acrylic resin, vinyl chloride resin, vinyl acetate resin, vinylidene chloride resin, polyvinyl alcohol, cellulose resin, polyamide, polyacetal, polycarbonate, polyester, fluorine-contained resin, silicone resin, natural rubber, rubber chloride, butadiene rubber, olefin rubber, phenolic resin, urea resin, melamine resin and polyimide.

* * * * *